US006170218B1

(12) United States Patent
Shahnazarian

(10) Patent No.: US 6,170,218 B1
(45) Date of Patent: Jan. 9, 2001

(54) JOIST BRACING APPARATUS

(75) Inventor: George Shahnazarian, Burnaby (CA)

(73) Assignee: MGA Construction Hardware & Steel Fabricating Ltd., Maple Ridge (CA)

( * ) Notice: Under 35 U.S.C. 154(b), the term of this patent shall be extended for 0 days.

(21) Appl. No.: 09/172,999

(22) Filed: Oct. 15, 1998

(30) Foreign Application Priority Data

Mar. 6, 1998 (CA) ..... 2231483

(51) Int. Cl.[7] ..... E04C 3/02; E04B 1/38
(52) U.S. Cl. ..... 52/713; 52/693; 52/696
(58) Field of Search ..... 52/696, 695, 693, 52/657, 317, 638, 713; 248/200.1, 57, 70

(56) References Cited

U.S. PATENT DOCUMENTS

| | | | | |
|---|---|---|---|---|
| 457,664 | | 8/1891 | Paine . | |
| 1,574,329 | * | 2/1926 | White . | |
| 1,649,226 | * | 11/1927 | Gstalder . | |
| 2,350,113 | | 5/1944 | Hurley . | |
| 2,442,726 | * | 6/1948 | Gstalder . | |
| 2,670,919 | * | 3/1954 | Esoldi . | |
| 2,856,646 | | 10/1958 | Latimer et al. . | |
| 2,914,816 | * | 12/1959 | Lundgren . | |
| 2,963,127 | | 12/1960 | Manville . | |
| 3,077,009 | | 2/1963 | Taber et al. . | |
| 3,102,306 | | 9/1963 | Hutchinson . | |
| 3,518,421 | * | 6/1970 | Cogdill . | |
| 3,606,217 | * | 9/1971 | Leiferman . | |
| 4,122,647 | | 10/1978 | Kovar . | |
| 4,246,736 | | 1/1981 | Kovar et al. . | |
| 4,513,994 | * | 4/1985 | Dover et al. | 248/57 X |
| 4,794,746 | | 1/1989 | Ramer . | |
| 4,947,612 | | 8/1990 | Taylor et al. . | |
| 5,044,582 | * | 9/1991 | Walters | 248/57 |
| 5,074,515 | * | 12/1991 | Carter | 248/57 X |
| 5,240,032 | * | 8/1993 | Mizioch | 137/368 |
| 5,301,486 | | 4/1994 | Taylor . | |
| 5,457,928 | | 10/1995 | Sahnazarian . | |
| 5,546,716 | * | 8/1996 | Broxterman et al. | 52/220.1 |
| 5,678,799 | * | 10/1997 | Jorgensen et al. | 248/200.1 X |
| 5,697,725 | * | 12/1997 | Ballash et al. | 403/231 |
| 5,934,631 | * | 8/1999 | Becker et al. . | |
| 5,937,608 | * | 8/1999 | Kucirka | 52/695 |
| 5,938,157 | * | 8/1999 | Reiker | 248/200.1 |

FOREIGN PATENT DOCUMENTS

| | | |
|---|---|---|
| 1285739 | 4/1989 | (CA) . |
| 2060753 | 6/1993 | (CA) . |
| 2102171 | 11/1993 | (CA) . |
| 1325095 | 12/1993 | (CA) . |
| 23444 | of 1893 | (GB) . |

* cited by examiner

*Primary Examiner*—Robert Canfield
(74) *Attorney, Agent, or Firm*—Bereskin & Parr

(57) ABSTRACT

An apparatus for bracing joists comprising a pair of load distribution members and a spanning member. The load distribution members are fastened to adjacent joists and connected together by the spanning member. The load distribution members each have a connector arm which contains a plurality of holes into which tabs on each end of the spanning member are sized to fit. The spanning member can thus connect the load distribution members over a range of distances providing a length adjustable joist bracing apparatus.

22 Claims, 10 Drawing Sheets

JOIST BRACING APPARATUS

FIELD OF THE INVENTION

This invention relates to an apparatus for bracing a pair of parallel joists or beams.

BACKGROUND OF THE INVENTION

Use of bracing between joists in floor construction is well known. One objective of bracing is to prevent joists from moving out of a square alignment with the floorboards they are supporting. Without bracing, joists may rotate about a horizontal axis resulting in floors that "squeak" due to a gap developing between the bottom of the floorboard and the non-horizontal surface of the joist. Bracing also strengthens the overall joist structure by distributing the load between joists.

A wide variety of bracing systems have been utilized, the traditional and most common being a pair of wooden members arranged in an X-pattern between a pair of joists. Such a brace system does not produce a consistently strong product, as the quality of wood for each brace may vary considerably. Wood braces have a tendency to warp as they dry, thus moving from their optimal support position. Further, the nailing of wood braces to joists can result in splitting of the brace where it is nailed to the joist, thus reducing structural strength.

Although various building regulations exist to specify the distance between floor joists, these regulations are not always adhered to. To reduce costs in a building that does not require standard spaced floor joists, fewer joists are installed resulting in a greater distance between joists. In addition, errors in construction can result in joists not being consistently spaced. Braces of fixed length will not support joists that are separated by variant lengths.

U.S. Pat. No. 457,664 discloses steel crossbraces designed to fit over the tops and bottoms of joists and to be adjustably connected by a nut and bolt. Such a brace requires that the bracing be installed before the floor is laid and will raise the floor above the joists in the area where the floor contacts the brace. In order to provide a level, squeak resistant floor, the installer must add material to the joists between the braces or recess the floor where it contacts the braces.

U.S. Pat. Nos. 3,077,009 and 3,102,306 disclose an adjustable brace and a method for manufacturing the brace. Such braces lack a secure connection to the joists and will detach from the joist if the joists warp so that the compression they provide upon the brace no longer exists.

U.S. Pat. No. 4,246,736 discloses a one piece bracing system of fixed length. Since the brace attaches only to the topmost section of each joist, it is less able to brace against joist twisting.

U.S. Pat. No. 4,794,746 discloses a bracing system of fixed length. The problem with fixed length braces is that if the joists are not spaced apart a distance equal to the length of the brace, the brace will either be too long to fit between the joists or be too short to adequately support the joists.

U.S. Pat. No. 5,301,486 discloses a cross brace that uses wooden components, each of which requires precise cuts to be made in order for the components to fit. Constructing such a brace would be costly and time consuming. As mentioned earlier, wood braces have a number of problems that make them less than optimal as bracing members.

Thus, there is a need for an inexpensive, strong, adjustable and easily installable joist bracing apparatus. There is also a need for a bracing apparatus that reduces bounce and vibration in floor systems such as I-joist supported floors. The present invention meets these criteria.

BRIEF SUMMARY OF THE INVENTION

In one aspect the invention is directed to an apparatus for bracing a pair of adjacent joists comprising: a pair of load distribution members; fastening means for fastening the load distribution members in opposing positions to the pair of adjacent joists; a spanning member for rigidly connecting the load distribution members together to brace said adjacent joists; and connecting means for connecting the spanning member to the load distribution members at one of a plurality of adjustable positions, to accommodate different spans between the pair of adjacent joists.

Further embodiments of the invention include a connector arm portion for extending at an angle from the load distribution member to receive the spanning member. Also, the connecting means comprises a plurality of apertures defined in the connector arm portion and a plurality of tabs protruding from the spanning member, the tabs being sized to removably fit into the apertures.

DETAILED DESCRIPTION OF PREFERRED EMBODIMENTS

Figure 1:
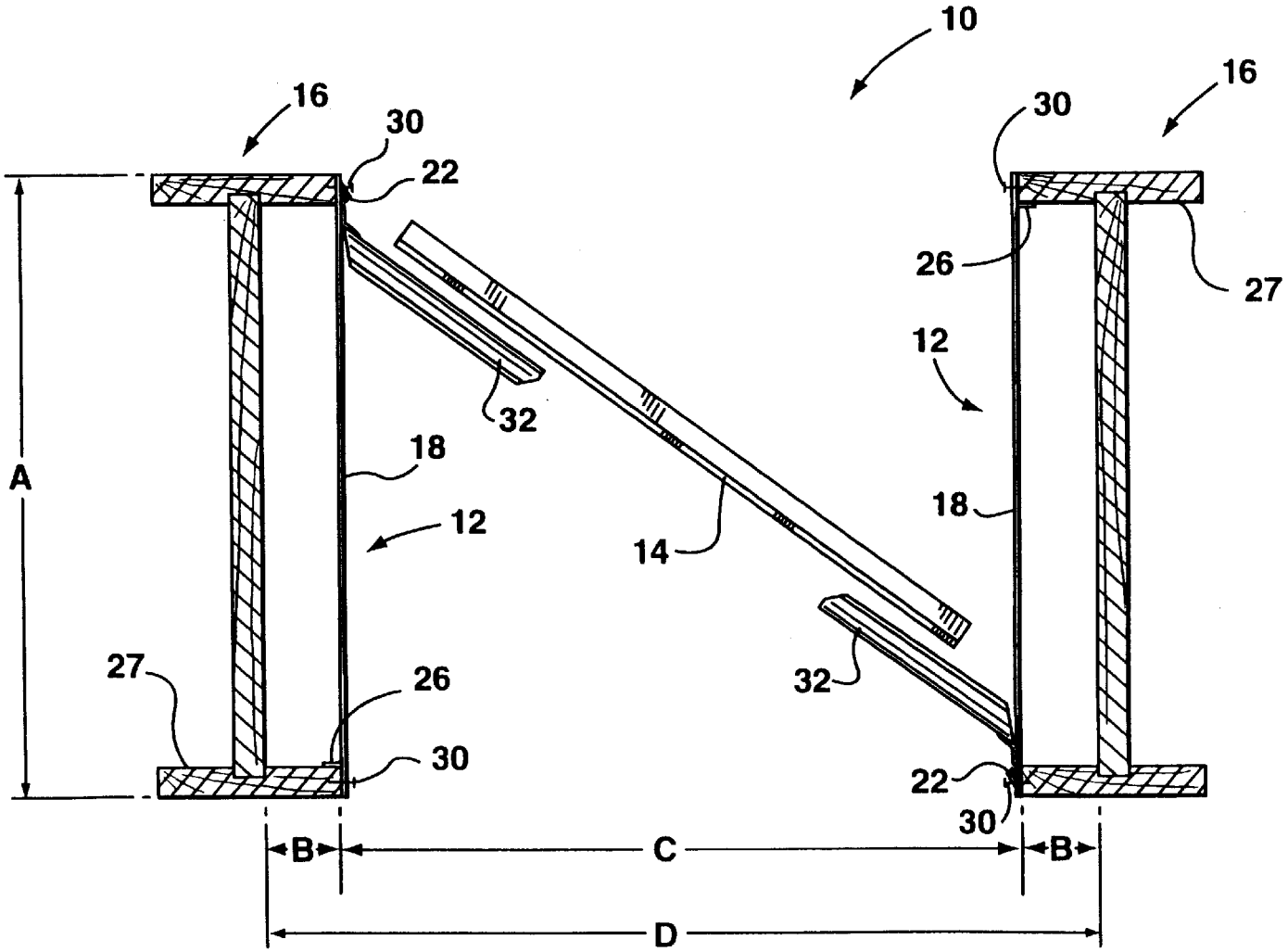
FIG. 1 is a side view of a joist bracing apparatus in accordance with the present invention, installed between two joists.

Referring first to FIG. 1, a joist bracing apparatus in accordance with the present invention is shown generally as 10. The joist bracing apparatus 10 includes a pair of load distribution members 12 and a spanning member 14. Joist bracing apparatus 10 is shown partially installed between two I-beam floor joists 16 in FIG. 1.

Figure 2:
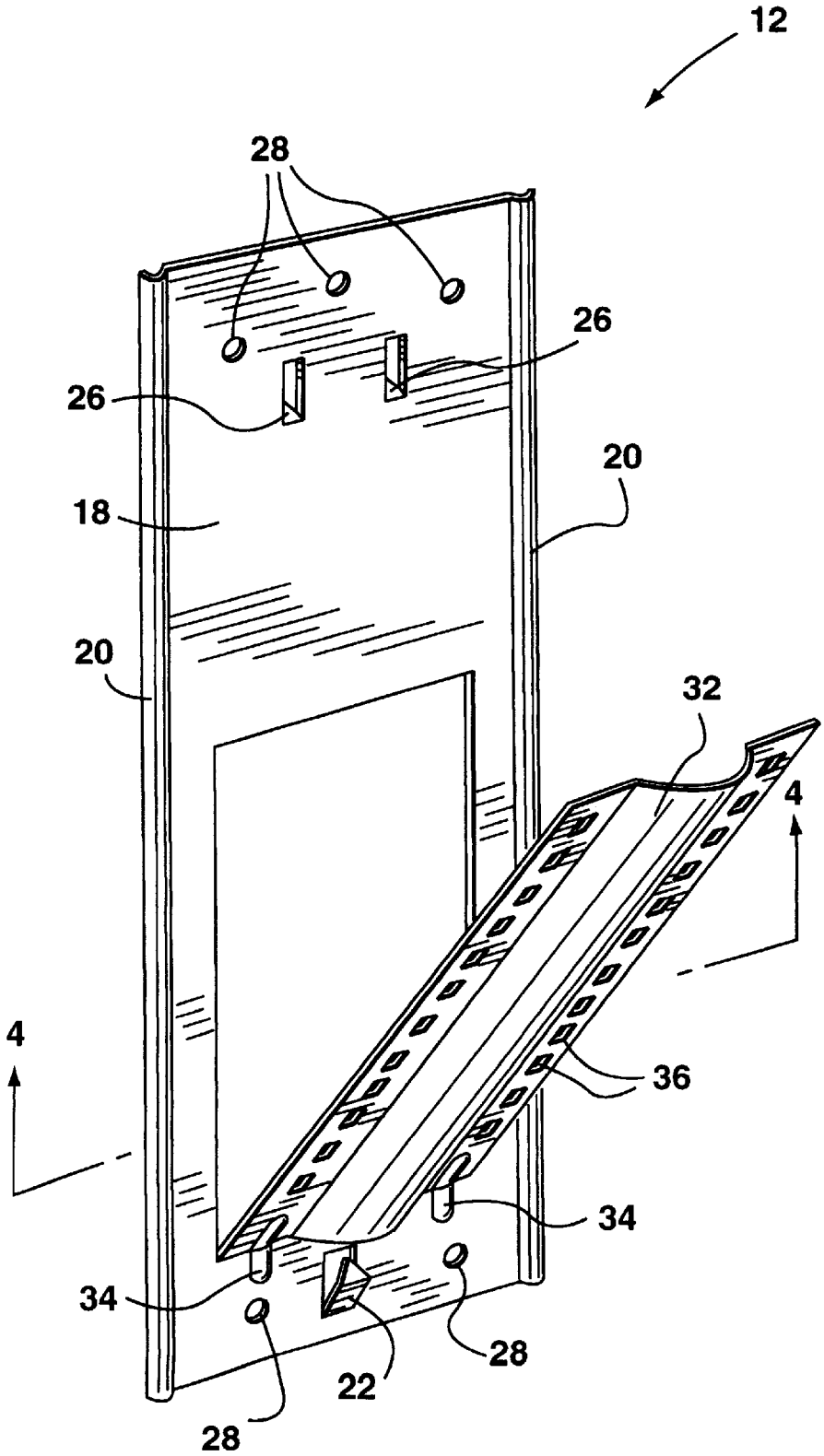
FIG. 2 is a perspective view of a load distribution member for the joist bracing apparatus of FIG. 1.
Figure 3:
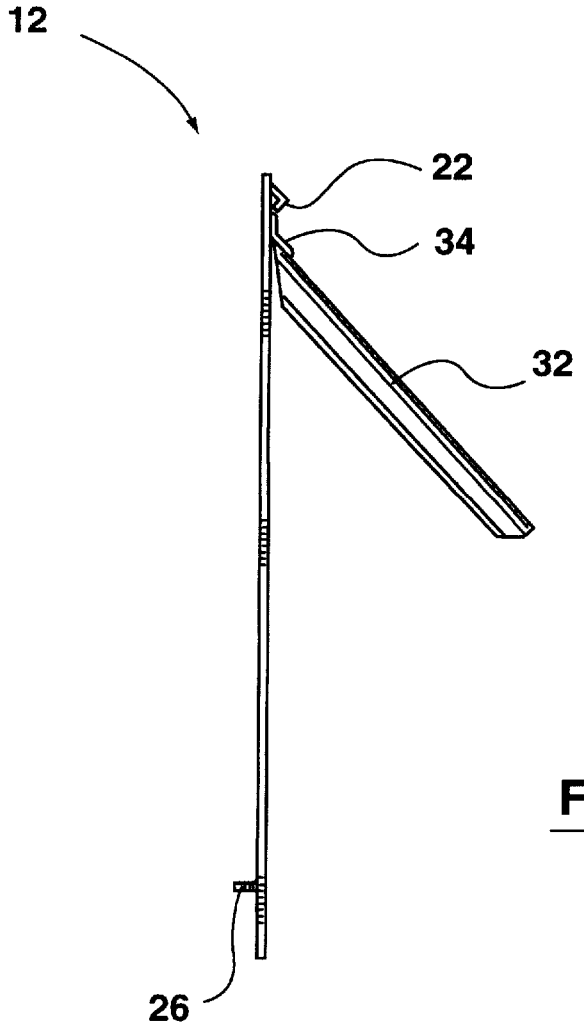
FIG. 3 is a side view of the load distribution member of FIG. 2.

In the preferred embodiment, each load distribution member 12 is constructed from a single piece of stamped sheet metal. Load distribution member 12 may be manufactured in a number of different lengths to accommodate the various depths of floor joists, shown as length A in FIG. 1. As shown in FIGS. 1 and 2 each load distribution member 12 has a planar portion 18. Planar portion 18 has, on its longest edges, longitudinal support ribs 20. Support ribs 20 are arcuate in shape and provide longitudinal strength to load distribution member 12. This longitudinal strength allows each load distribution member 12 to distribute the vertical load on a joist over the surface of the joist and the surfaces of the adjoining joists, thus helping to dampen movement in the floor. One end of planar portion 18 has a speed prong 22. Speed prong 22 is designed to temporarily fasten load distribution member 12 to the surface of a floor joist 16 when the speed prong 22 is hit with a hammer and thus driven into the surface of a floor joist 16. The other end of planar portion 18 has a pair of squaring tabs 26. Squaring tabs 26 extend from the rear face of load distribution member 12. Squaring tabs 26 when placed upon the interior horizontal face 27 of I-beam floor joist 16 serve as a squaring or levelling indicator to ensure that load distribution member 12 is substantially vertical prior to fastening to floor joist 16. In the case of floor joists that are not of I-beam type construction, squaring tabs 26 are either driven into the face of the floor joist or bent back to be parallel with planar portion 18. Planar portion 18 contains a plurality of apertures 28 to allow for more permanent attachment of load distribution member 12 to floor joist 16 through the use of fasteners 30 such as nails, screws or the like.

Planar portion 18 has integrally hingeably attached to it a connector arm 32. Connector arm 32 is integrally formed during manufacture by making cuts on three sides of a rectangle in planar portion 18 and stamping the central portion of the rectangle to form a U-shaped channel, thus defining connector arm 32. The edge of connector arm 32 remaining attached to planar portion 18 is reinforced by a pair of hinge support ribs 34. Hinge support ribs 34 protrude above the surface of the planar portion 18. Connector arm 32 has a plurality of adjustment apertures 36 sized to accept adjustment tabs 38, discussed further below, of spanning member 14.

Figure 4:
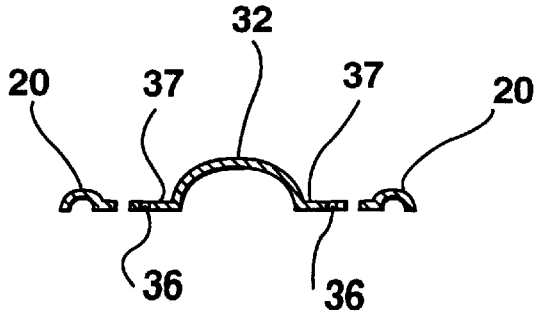
FIG. 4 is a sectional view of the load distribution member of FIG. 2, taken along line 4—4.

FIG. 4 is a sectional view of load distribution member 12 taken along line 4—4 of FIG. 2. Connector arm 32 is formed with a central U-shaped channel to provide a larger surface area and thus a stronger support than that which would be provided by a flat surface. Adjacent to each side of the central U-shaped channel of connector arm 32 are connector arm flanges 37. Adjustment apertures 36 extend through connector arm flanges 37.

Figure 5:
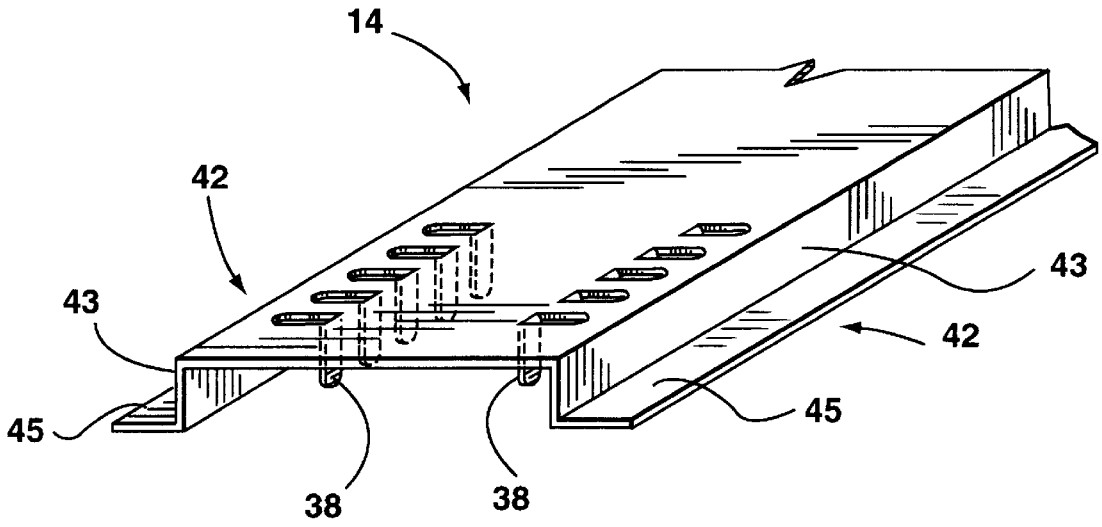
FIG. 5 is a perspective view of one end of a spanning member for the joist bracing apparatus of FIG. 1.

FIG. 5 is a perspective view of one end of spanning member 14. The ends of spanning member 14 are identical. Spanning member 14 is sized to adjustably connect to load distribution members 12 between a pair of floor joists. In the preferred embodiment spanning member 14 is manufactured in lengths of: twelve inches, sixteen inches, nineteen inches and twenty-four inches to accommodate a wide variety of installation requirements. As shown in FIG. 1, lengths A, B, C and D may all vary, depending upon the dimensions of the joist selected and the installation distance between joists. The variety of possible lengths for spanning member 14 allow the correct spanning member 14 to be selected over a wide range of possible joist configurations. Spanning member 14 has a plurality of adjustment tabs 38 that are sized to lockably fit adjustment apertures 36 of connector arm 32. Adjustment tabs 38 are finger-like in structure and integral to spanning member 14. Adjustment tabs 38 are created during the manufacture of spanning member 14 by cutting a finger-like shape into the surface of spanning member 14 leaving the base of adjustment tabs 38 connected to spanning member 14. Adjustment tabs 38 are then bent along the base attached to spanning member 14 to an angle of approximately ninety degrees below the top surface of spanning member 14. The finger tip ends of adjustment tabs 38 are preferably arcuate in shape to permit rapid connection with adjustment apertures 36. Any reasonable number of adjustment tabs 38 may be stamped into spanning member 14. Spanning member 14 may be constructed in a variety of cross-sectional forms as will be discussed further below. The preferred embodiment as illustrated in FIG. 5 has a planar top surface from which the adjustment tabs 38 project downward. On each side of the top surface are shoulders shown generally as 42, each shoulder 42 having a vertical wall 43 connected to a spanning member flange 45. The shoulders 42 serve to protect the adjustment tabs 38 from becoming bent prior to installation, for instance by someone accidentally stepping on the spanning member 14. The shoulders 42 further serve to support the adjustment tabs 38 and prevent the adjustment tabs 38 from bending in use.

Figure 6:
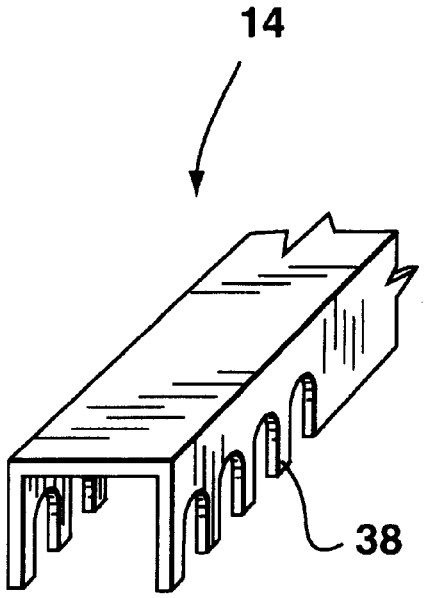
FIG. 6 is a perspective view of one end of an alternative embodiment of the spanning member.

FIG. 6 shows an alternative embodiment for spanning member 14, having no shoulders. Adjustment tabs 38 are formed by cutting slits into the vertical side walls of spanning member 14.

Figure 7:
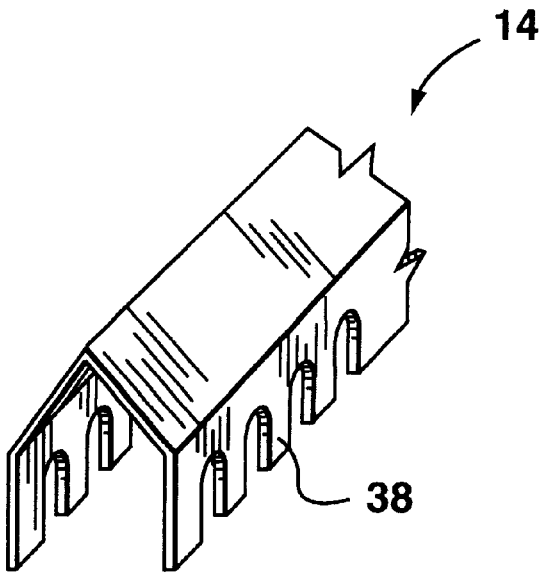
FIG. 7 is a perspective view of one end of an alternative embodiment of the spanning member.

FIG. 7 shows an alternative embodiment for spanning member 14, having no shoulders and a peaked top surface. Adjustment tabs 38 are formed by cutting slits into the vertical side walls of spanning member 14.

Figure 8:
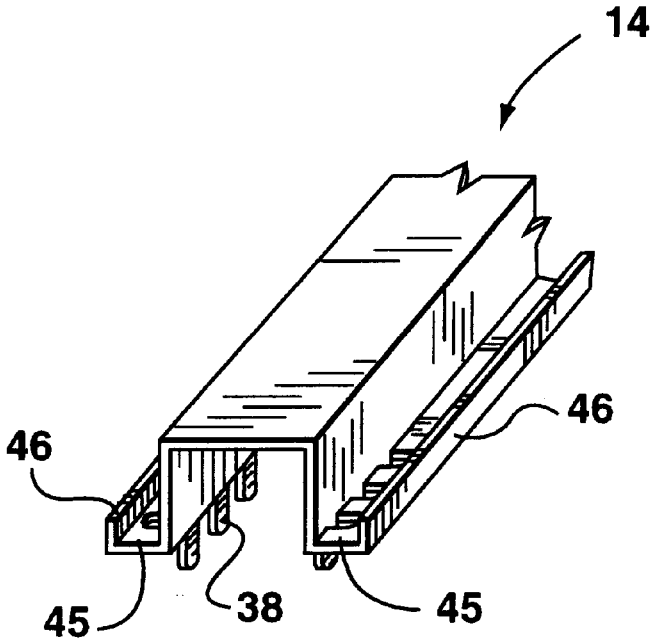
FIG. 8 is a perspective view of one end of an alternative embodiment of the spanning member.

FIG. 8 shows an alternative embodiment for spanning member 14. The spanning member 14 has spanning member flanges 45 with upturned end walls 46. Adjustment tabs 38 are created during the manufacture of spanning member 14 by cutting finger-like shapes into the surface of spanning member flanges 45 leaving the base of adjustment tabs 38 connected to spanning member 14. Adjustment tabs 38 are then bent to an angle of approximately ninety degrees below the surface of spanning member flanges 45. The finger tip ends of adjustment tabs 38 are preferably arcuate in shape to permit rapid connection with adjustment apertures 36.

Figure 9:
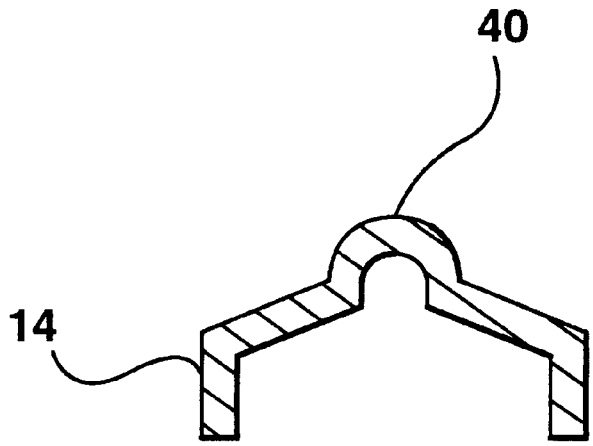
FIG. 9 is a vertical cross-sectional view of an alternative embodiment of the spanning member.

FIG. 9 shows an alternative cross-sectional shape for spanning member 14 having an outwardly extending rib 40.

Figure 10:
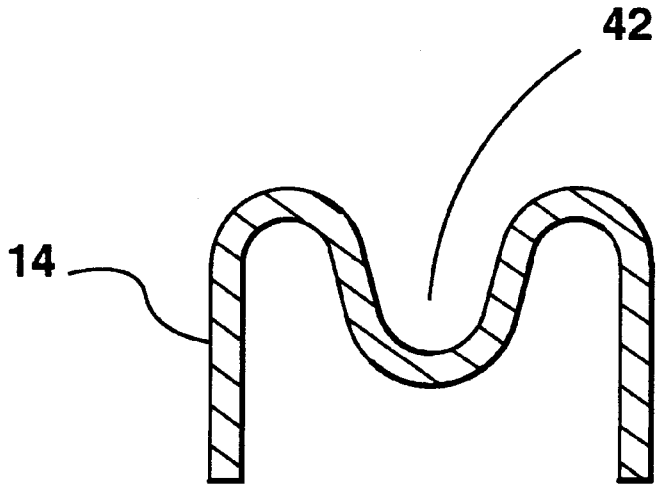
FIG. 10 is a vertical cross-sectional view of an alternative embodiment of the spanning member.

FIG. 10 shows an alternative cross-sectional shape for spanning member 14 having an inwardly extending rib 42.

Although the preferred embodiment utilizes a spanning member 14 of the configuration as illustrated in FIG. 5, any number of configurations may be selected that are cost effectively produced and provide sufficient load bearing strength. For example, the adjustment tabs 38, shelves 45 and walls 46 of FIG. 8 could be combined with the cross-sectional configuration of FIGS. 7, 9 or 10.

Figure 11:
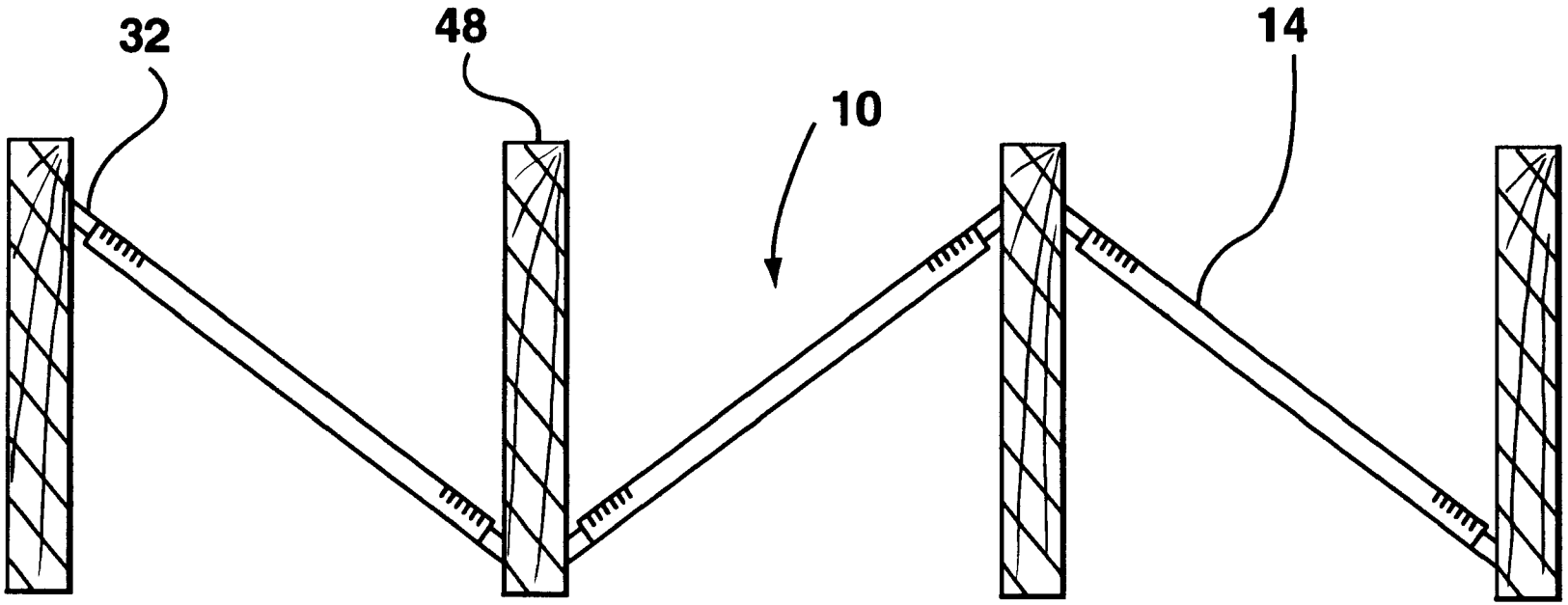
FIG. 11 is a side view of the joist bracing apparatus installed between a series of floor joists.

FIG. 11 shows joist bracing apparatus 10 installed between a series of conventional wooden joists 48. The joist bracing apparatus 10 are shown installed in a zig-zag pattern for optimal load distribution.

Figure 12:
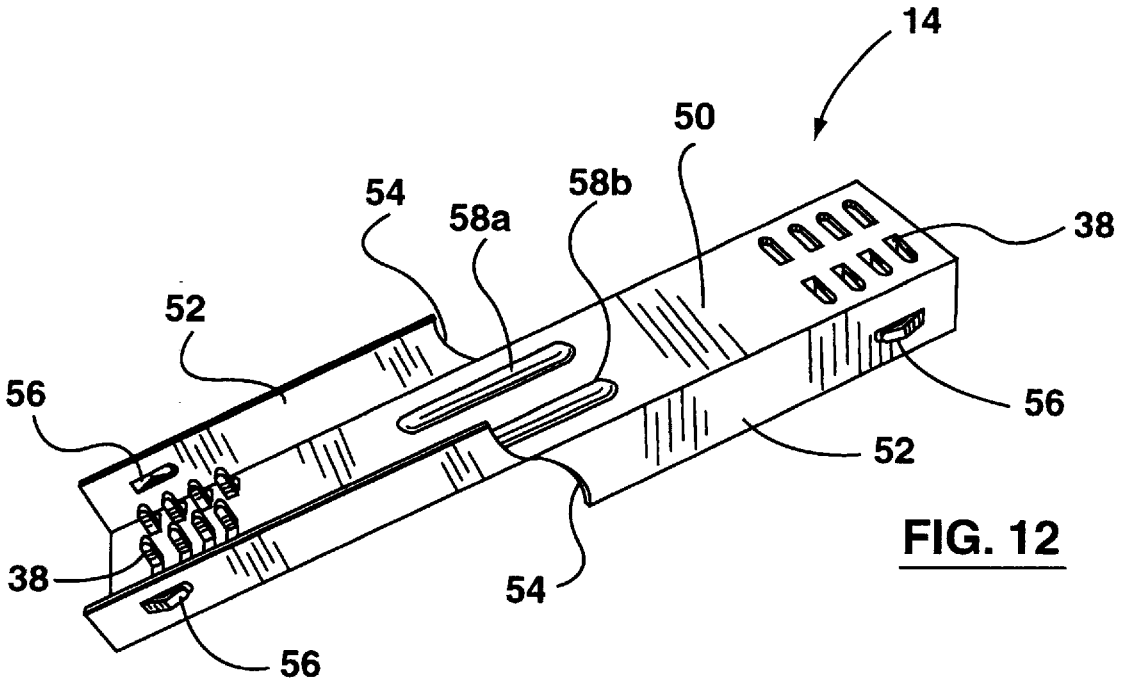
FIG. 12 is a perspective view of an alternative embodiment of the spanning member.

FIG. 12 shows another preferred embodiment of the spanning member 14. Spanning member 14 has a spanning member body 50 and two pairs of spanning member side walls 52. Each pair of side walls 52 are generally parallel to each other and extend at 90° degrees from spanning member body 50. As shown, one pair of sidewalls 52 extend above spanning member body 50 and, the other pair of spanning member side walls 52 descend below spanning member body 50. Spanning member side wall 52 intersects an arcuate trailing edge 54 located toward the central portion of spanning member 14. Each spanning member side wall 52 has a locking prong 56 located centrally in the spanning member side wall 52 beneath the plurality of adjustment tabs 38. The locking prong 56 serves to lock the connector arm 32 to the spanning member 14 once they are engaged.

Spanning member body 50 also includes a pair of ribs 58*a* and 58*b*. In the preferred embodiment one of ribs 58*a* or 58*b* is recessed into spanning member body 50 and the other rib extends above the surface of spanning member body 50. The ribs 58*a* and 58*b* serve to provide longitudinal rigidity to the centre portion of the spanning member body 50.

Figure 13:
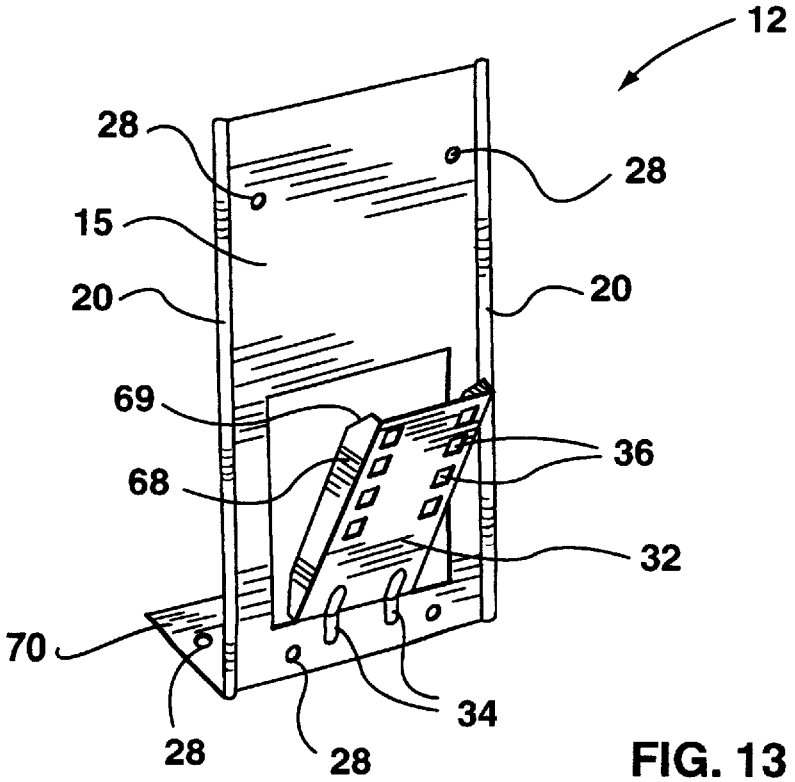
FIG. 13 is a perspective view of an alternative embodiment of the load distribution member.

FIG. 13 shows the preferred embodiment of distribution member 12 designed to be connected with the spanning member 14 of FIG. 12. In this embodiment of distribution member 12, connector arm 32 has a pair of opposed connector arm side walls 68. Each side wall 68 is angled at slightly greater than 90° from planar portion 18. This allows the side walls 68 to bend to form a friction fit with sidewalls 52 of spanning member 14. The end 69 of each connector side wall 68 has a tapered edge 69, to eliminate a sharp edge at the terminus of connector side wall 68. Distribution member 12 has at one end a distribution member flange 70 extending at approximately 90 degrees from planar portion 18. Planar portion 18 and distribution member flange 70 contain a plurality of apertures 28 through which nails, screws, or the like may be inserted to secure distribution member 12 to a joist.

Figure 14:
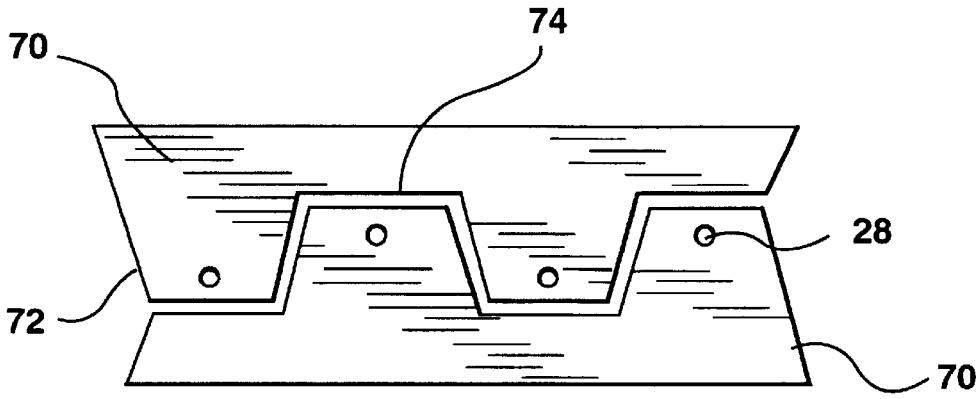
FIG. 14 is a plan view of the intersection of two load distribution member flanges.

FIG. 14 is a plan view of the intersection of two distribution member flanges 70. Each distribution member flange 70 has a plurality of teeth 72 and recesses 74 that are configured to permit the distribution member flanges 70 of a pair of distribution members 12 mounted on opposing sides of a narrow floor joist to intersect, thus avoiding any potential overlap of distribution member flanges 70. Each tooth 72 of distribution member flange 70 contains an aperture 28 through which a nail, screw, or the like may be inserted to attach distribution member flange 70 to a joist.

Figure 15:
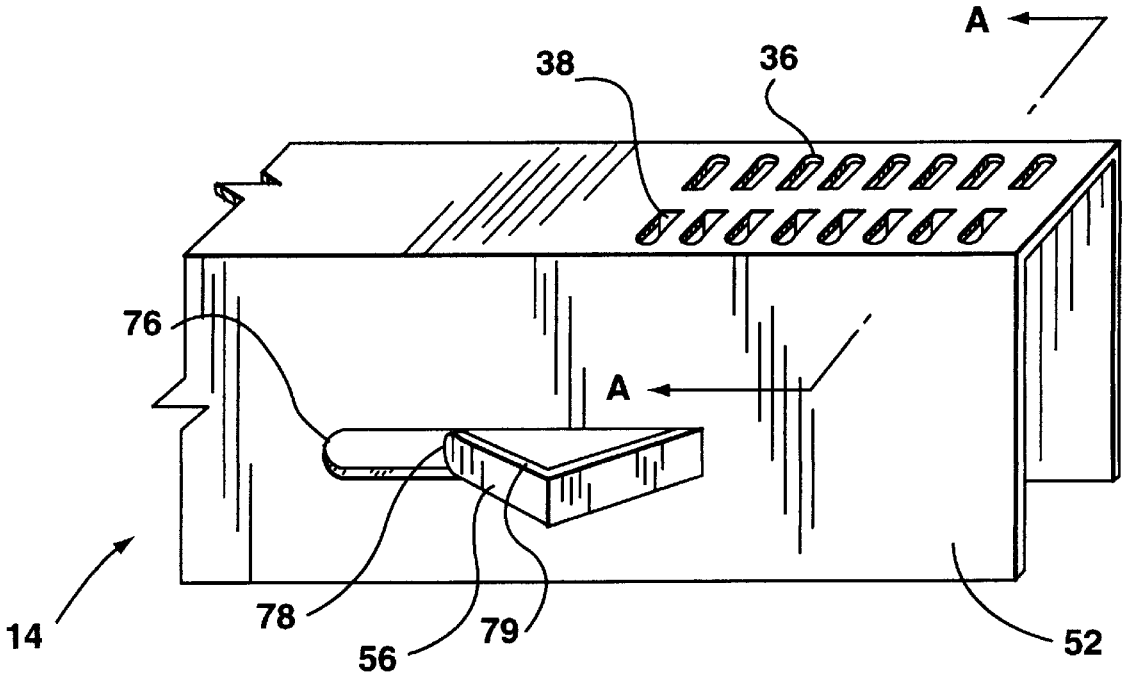
FIG. 15 is a perspective view of one end of the spanning member of FIG. 12.

FIG. 15 is a perspective view of one end of the preferred embodiment of spanning member 14 as shown in FIG. 12. Locking prong 56 is shown in a disengaged position within spanning member side wall 52. Locking prong 56 is created by cutting an elongate locking prong aperture 76 into spanning member side wall 52 and leaving the material cut from locking prong aperture 76 attached at one end to spanning member side wall 52. This attached material is then bent outwardly from spanning member side wall 52 during manufacture to form locking prong 56. In use, once connector arm 32 has been inserted into the channel of spanning member 14 locking prong 56 is driven inwardly by using a hammer or the like. This serves to lock connector arm 32 within the channel of spanning member 14. Locking prong 56 preferably includes a tapered top edge 79 so that its height at engaging end 78 is less than the height of the end remaining attached to spanning member side wall 52. Further, engaging end 78 is preferably arcuate. Both of these features act as a wedge to ease the locking engagement of locking prong 56 with the edge of connector arm side wall 68.

Figure 16:
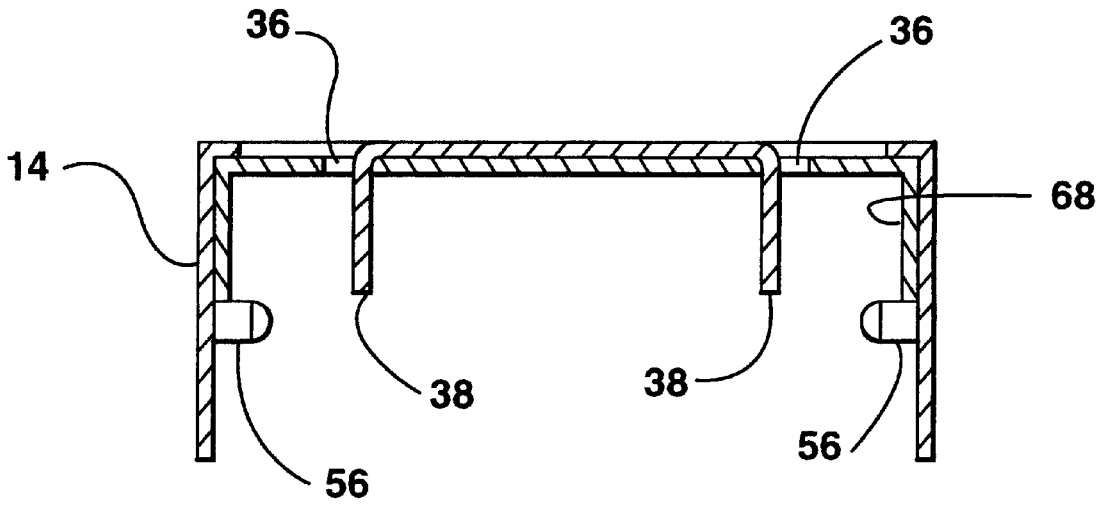
FIG. 16 is a cross-section of the spanning member of FIG. 12 and the load distribution member of FIG. 13 in a mated position viewed along line A—A of FIG. 15.

FIG. 16 is a cross-section of the spanning member 14 of FIG. 12 and the distribution member 12 of FIG. 13 in the engaged position viewed along line A—A of FIG. 15. In the engaged position the adjustment tabs 38 of spanning member 14 extend through the adjustment apertures of connector arm 32. Locking prongs 56 firmly engage the edge of connector arm side walls 68. In the preferred embodiment adjustment tabs 38 are tapered so that they are widest at the base. The width of the base being such as to provide a snug fit of adjustment tabs 38 within adjustment apertures 36.

In use, the user first bends connector arm 32 outwardly from the planar portion 18 of the load distribution member 12. The load distribution members 12 are preferably shipped with the connector arm 32 non-extended to reduce the volume of packaging required. Once the connector arm 32 has been bent to a desired angle of approximately 45 degrees, the load distribution member 12 is positioned against the floor joist 16 with load distribution member 70 abutting the top most or bottom most exterior surface of a floor joist. The load distribution member 12 is then secured to the floor joist 16 by driving fasteners 30 through apertures 28 into the floor joist 16. During installation, a first load distribution member 12 is attached to a floor joist 16 with the connector arm 32 extending upwardly and a second load distribution member 12 is installed to an opposing floor joist with the connector arm 32 extending downwardly. The connector arms 32 of the first and second load distribution members 12 are then connected by linking the connector arms 32 with the spanning member 14. Locking prongs 56 are then struck with a hammer causing them to lock connecting arms 32 within spanning members 14. For optimal support on a floor, the bracing members should form a zig-zag pattern between the floor joists 16 as shown in FIG. 11.

In an alternative method of use, the joist bracing apparatus 10 may be assembled to a fixed length prior to installation. As each floor joist 16 is installed, a number of assembled joist bracing apparatus 10 are attached to the face of floor joist. The assembled joist bracing apparatus 10 may then be used as spacers to determine where to install the adjacent floor joist.

One particular advantage provided in the above described invention is the reduction in bounce and vibration for I-joist floor systems.

Although referring to floor joists throughout, this invention is not meant to be restricted to only floor supporting joists. Ceiling joists or other load bearing joists would also benefit from the use of this invention to distribute loads and prevent twisting of the joists.

As will be apparent to those skilled in the art, various modifications and adaptations of the apparatus as described above are possible without departing from the present invention, the scope of which is defined in the appended claims.

The embodiments of the invention in which an exclusive property or privilege is claimed are defined as follows:

1. An apparatus for bracing a pair of adjacent joists comprising;

a) a pair of load distribution members mountable with fasteners respectively to said pair of joists;

b) a spanning member for extending diagonally between an upper region of one of said adjacent joists, and a lower region of the other of said adjacent joists; and c) connectors for rigidly connecting said spanning member to said load distribution members at one of a plurality of adjustable positions, to accommodate different spans between said pair of adjacent joists.

2. The apparatus of claim 1 wherein each said load distribution member includes a connector arm portion, for extending at an angle from said load distribution member to receive said spanning member.

3. The apparatus of claim 1 wherein said load distribution members each comprise a speed prong.

4. The apparatus of claim 1 wherein said load distribution members define a plurality of apertures for receiving said fasteners.

5. The apparatus of claim 2 wherein said connectors comprise a plurality of apertures defined in said connector arm portion and a plurality of tabs protruding from said spanning member, said tabs being sized to removably fit into said apertures.

6. The apparatus of claim 5 wherein said apertures are rectangular in shape.

7. The apparatus of claim 1 wherein said load distribution members have a planar surface for contacting a corresponding planar surface on said joists.

8. The apparatus of claim 7 wherein said load distribution members have longitudinal ribs add longitudinal rigidity to said planar surface.

9. The apparatus of claim 2 wherein said connector arm portion has a central portion which is arcuate in cross-section along a substantial portion of the length of said connector arm.

10. The apparatus of claim 1 wherein said spanning member is arcuate in cross-section.

11. The apparatus of claim 10 wherein said spanning member has an inwardly projecting rib.

12. The apparatus of claim 10 wherein said spanning member has an outwardly extending rib.

13. The apparatus of claim 1 wherein said load distribution member is stamped from a single piece of metal.

14. The apparatus of claim 2 wherein said connector arm portion is integrally connected to said load distribution member.

15. The apparatus of claim 14 wherein said integral connection between said connecter arm portion and said load distribution member is reinforced by hinge ribs.

16. The apparatus of claim 1 wherein said load distribution members further comprise a pair of squaring tabs, for engaging said joists, each of said squaring tabs extending at an angle of approximately ninety degrees from the face of said load distribution member.

17. The apparatus of claim 5 wherein said spanning member includes shoulders for protecting said tabs from becoming bent.

18. The apparatus of claim 17 wherein said shoulders include vertical walls being longer in length than said tabs.

19. The apparatus of claim 1 wherein said spanning member contains locking means to prevent disengagement of said spanning member from said load distribution members once said spanning member and said load distribution members are connected.

20. The apparatus of claim 19 wherein said locking means comprises a locking tab, said locking tab connected to but exterior to a side wall of said spanning member, said locking tab designed to be moved to a position interior to said side wall once said spanning member and said load distribution members are connected.

21. An apparatus for bracing a pair of adjacent joists comprising:

a) a pair of load distribution members mountable with fasteners respectively to said pair of joists;

b) a spanning member for rigidly connecting said load distribution members together to brace said adjacent joists, the spanning member including at least one locking tab to prevent disengagement of said spanning member from said load distribution members once said spanning member and said load distribution members are connected, said locking tab being connected to but exterior to a side wall of said spanning member, said locking tab being moveable to a position interior to said side wall once said spanning member and one of said load distribution members are connected; and d) connectors for connecting said spanning member to said load distribution members at one of a plurality of adjustable positions, to accommodate different spans between said pair of adjacent joists.

22. An apparatus for bracing a pair of adjacent I-joists, said apparatus comprising:

a) a pair of load distribution members mountable with fasteners respectively to said pair of I-joists;

b) a spanning member for extending diagonally generally between an upper region of one of said adjacent I-joists, and a lower region of the other of said adjacent I-joists; and c) connectors for rigidly connecting said spanning member to said load distribution members at one of a plurality of adjustable positions, to accommodate different spans between said pair of adjacent I-joists.

* * * * *